US005281435A

United States Patent [19]

Buecher

[11] Patent Number: 5,281,435

[45] Date of Patent: Jan. 25, 1994

[54] CONTINUOUSLY COATING A MOVING METAL STRIP

[75] Inventor: Udo W. Buecher, Shellharbour, Australia

[73] Assignees: John Lysaght (Australia) Limited, Sydney; Taubmans Property Limited, Villawood, both of Australia

[21] Appl. No.: 819,233

[22] Filed: Jan. 10, 1992

[30] Foreign Application Priority Data

Jan. 10, 1991 [AU] Australia ..... PK4156

[51] Int. Cl.[5] ..... B05D 3/02; B05D 3/12; B05C 11/00

[52] U.S. Cl. ..... 427/11; 427/318; 427/359; 427/374.5; 427/386; 427/388.2; 118/77; 118/112; 118/118; 118/123

[58] Field of Search ..... 427/11, 386, 374.5, 427/388.2, 318, 359; 118/77, 112, 118, 123

[56] References Cited

U.S. PATENT DOCUMENTS

| | | | |
|---|---|---|---|
| 1,383,740 | 7/1921 | Meyer . | |
| 2,327,739 | 8/1943 | Peters | 175/366 |
| 2,955,952 | 9/1956 | Herbst | 427/386 |
| 3,305,392 | 2/1967 | Britt | 117/154 |
| 3,505,094 | 4/1970 | Arutunian | 117/50 |
| 3,551,184 | 12/1970 | Dremann et al. | 117/50 |
| 3,553,007 | 1/1971 | Hennig et al. | 117/120 |
| 3,630,802 | 12/1971 | Dettling | 156/231 |
| 3,791,856 | 2/1974 | Duling et al. | 427/374.5 |
| 4,930,675 | 6/1990 | Bedford et al. | 228/112 |
| 4,959,241 | 9/1990 | Thomas et al. | 427/11 |
| 5,059,446 | 10/1991 | Winkle, Sr. et al. | 427/195 |

FOREIGN PATENT DOCUMENTS

| | | | |
|---|---|---|---|
| 3919620 | 12/1990 | Fed. Rep. of Germany . | |
| 2431363 | 2/1980 | France . | |
| 85129 | 12/1917 | Switzerland . | |
| 836211 | 6/1981 | U.S.S.R. | 427/11 |

*Primary Examiner*—Shrive Beck
*Assistant Examiner*—David M. Maiorana
*Attorney, Agent, or Firm*—Nikaido, Marmelstein, Murray & Oram

[57] ABSTRACT

A metal strip (4) is continuously coated with a thermoset resin based paint by passing it through a pre-heating furnace (5) wherein it is raised to a pre-heat temperature of from 100° to 210° C., then through a coating applicator (6) wherein a solid, substantially solvent free block (11) of the paint composition is pressed against the strip (4) at a substantially constant pressure of from 10 to 100 kilopascals to cause a liquid layer (13) of the paint composition to be deposited on the strip, then through a roll type smoothing device (18) to smooth and spread the layer and doctor it to thickness, then through a curing furnace (8) to thermoset the layer, and finally through a quenching bath (9).

18 Claims, 2 Drawing Sheets

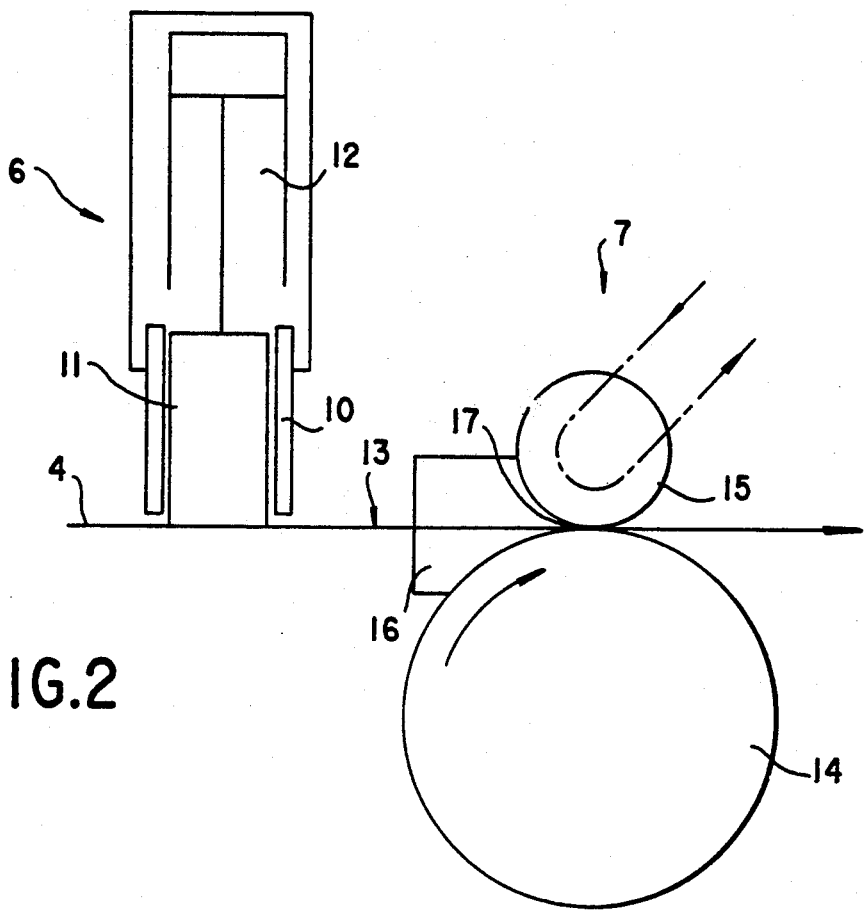
FIG.2
FIG.3
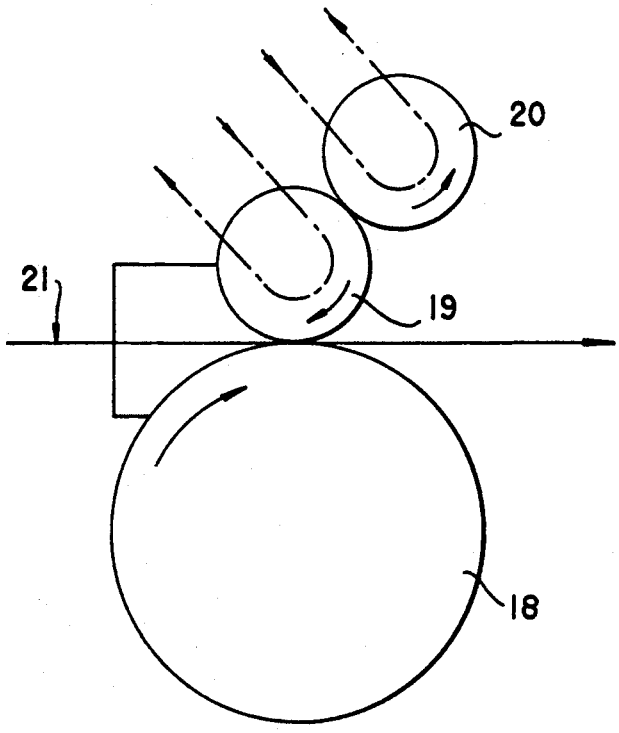

CONTINUOUSLY COATING A MOVING METAL STRIP

FIELD OF THE INVENTION

This invention relates to the large scale, continuous coating of moving substrate metal strips with ornamental and/or protective coatings of film forming, organic, polymeric materials. Typically the invention is applicable to the production in a steel finishing mill of prepainted steel strip, such as is used as the starting material in the production of building cladding sheets, appliance cabinets, vehicle bodies and many other sheet metal products.

BACKGROUND OF THE INVENTION

For the most part, in such production processes the coating is applied to the strip as a liquid paint, in which the constituents, namely the polymeric materials, pigments and maybe inert fillers, are held in a solvent. The paint constituents are left as a film on the strip as a result of the solvent evaporating, either naturally or on being heated. If the film forming polymeric material is of the thermoplastic type, the removal of the solvent virtually completes the process. If the polymeric material is of the thermosetting type, a subsequent heating is required to effect the cross-linking which causes the film to harden.

In large scale plants, the storage handling and, in particular, the recovery, of the considerable volumes of environmentally hazardous solvents involved, requires care and the provision of expensive equipment, if the working environment is to be satisfactory.

In other situations, it is known to use the so called dry-powder coating process. Briefly stated, this process comprises spraying electrostatically charged, dry particles of a paint composition on to an oppositely charged article to be coated, and then heating the powder layer to form a film and, if needed, thermoset the film. That process eliminates the solvent, but is not suitable for continuous strip coating because of the severe limitations the application of the powder would impose on the strip speed. Furthermore, powder coatings are inherently thicker than those preferred on stock strip material.

Therefore, it is an object of the present invention to provide a coating process which is suitable for use in a high speed, continuous coating plant and which eliminates the need for solvent recovery.

A further disadvantage of conventional practice using liquid coating compositions, is the wastage, and more importantly, the time delays, associated with changing from one coating to another to suit requirements for differently coloured, or otherwise differently coated, products. At such a changeover it is necessary to drain and clean the pipe lines, pumps, applicator and all other equipment contacted by the coating material, to avoid contamination of the fresh coating with the old. This has led to long product runs, with consequent large inventories of finished stock and lack of flexibility in meeting orders for small quantities of seldom required product.

Ideally, production would be scheduled to meet each individual order as received, and another object of the present invention is to provide a continuous strip coating process enabling a changeover time which is small enough to permit that ideal situation to be largely attained.

SUMMARY OF THE INVENTION

As indicated above the objects of the invention are to provide a substantially solvent free coating process, which is suitable for use in a continuous, high speed, strip coating mill, and which enables a short changeover time from one coating to another to be attained.

The invention achieves those objects primarily by applying a liquid layer of a paint composition to the strip by pressing a solid block of a high solids content, essentially solvent free, polymer based paint composition against the moving strip, while the strip is hot enough to cause a surface layer of the block contiguous to the strip to soften and be carried away as the liquid layer thereon.

It was found in experiments leading to the invention that thermoplastic polyr r based paint compositions were unsuitable, in that such compositions, if they were non-tacky solids at room temperature, took too long to be reduced to a low viscosity liquid when utilising strip temperatures which were feasible in practice. On the other hand, compositions based on thermosetting polymers having relatively low glass transition temperatures performed satisfactorily, provided the as formed liquid layer was smoothed before it had time to increase substantially in viscosity due to cross-linking.

Therefore, the invention consists in a method of continuously coating a moving metal strip comprising the steps of pre-heating the strip to a temperature above the glass transition temperature of the polymer of a thermosetting polymer based, substantially solvent-free, paint composition, holding a solid block of that paint composition against the pre-heated strip while maintaining sufficient pressure between the block and the strip to cause a liquid layer of the paint composition to be carried away from the block on the strip, smoothing the layer, and thereafter further heating the smoothed layer to a curing temperature to produce a thermoset adherent coating on the strip.

The invention further consists in apparatus for effecting the method of the invention comprising a device to cause the strip to travel along a predetermined pass line and further apparatus treating the strip sequentially as it travels along the pass line, the further apparatus comprising, a pre-heating furnace adapted to pre-heat the strip to a predetermined pre-heating temperature, a coating applicator adapted to hold a solid block of a paint composition and maintain the block in contact with the pre-heated strip, whereby a liquid layer of the paint composition is applied to the strip, smoothing device whereby the liquid layer is spread substantially evenly over one side of the strip, and a curing furnace whereby the evenly spread layer is further heated to a curing temperature to produce an adherent coating on the strip.

In some instances the pressure between the block and the strip is maintained at a critical value at which the liquid layer is substantially the required thickness for the finished coat of paint, in others the as formed liquid layer is somewhat thicker than desired, and the smoothing is effected while doctoring the liquid layer to the required thickness.

BRIEF DESCRIPTION OF THE DRAWINGS

By way of example, an embodiment of the above described invention is described in more detail hereinafter with reference to the accompanying drawings.

FIG. 2 is a diagrammatic view of the applying and smoothing equipment of the line of FIG. 1 drawn to a larger scale.

FIG. 3 is a view similar to FIG. 2 of an alternative smoothing equipment.

DESCRIPTION OF THE PREFERRED EMBODIMENT

Figure 1:
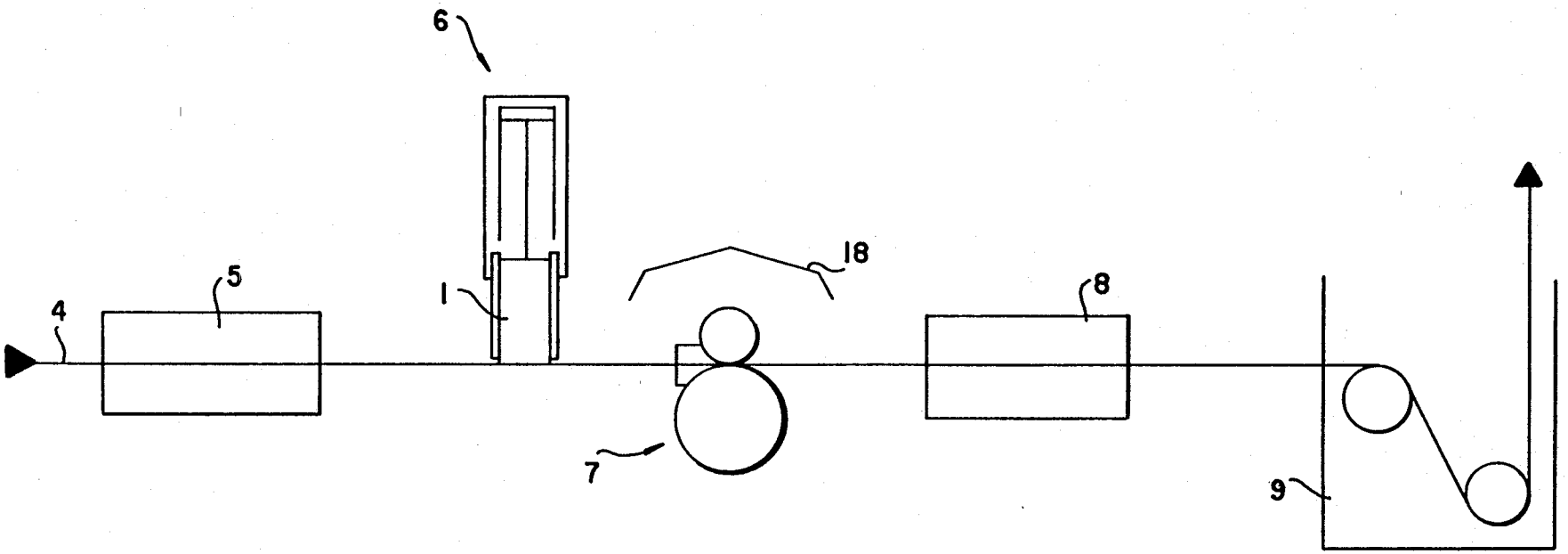
FIG. 1 is a diagrammatic side elevation of a continuous strip coating production line according to the invention.

In accordance with the embodiment of the invention illustrated by FIGS. 1 and 2, a steel strip 4, which is to be continuously coated, is caused to travel sequentially through a preheating furnace 5, a coating applicator 6, a smoothing device 7, a curing furnace 8, and a quenching bath 9.

The illustrated apparatus may be an integral, final part of a continuous galvanising line, but more usually it is fed from a conventional un-coiler (not shown) loaded with coiled strip from stock. The coated strip emerging from the bath 9 is taken up by a conventional re-coiler (not shown) and the line would be fitted with other conventional adjuncts, such as accumulators and means to maintain tension in the strip.

The incoming strip 4 is pre-treated to render it suitable for receiving a finishing coat of paint, that is to say it would be levelled, cleaned and probably primed. All of these operations may be effected by conventional means. In particular, the strip may be primed with a solvent based primer composition in the usual manner, wherein the strip with a liquid primer coating on it is passed through a conventional curing furnace to drive off the solvent and cure the primer. The primer coat is preferably very thin, for example within the range of from 3 to 20 microns, preferably about 5 microns, and so requires only very little solvent to be used in its formation. Alternatively, the primer coat may itself be applied by a method or apparatus according to the present invention.

The primed strip emerges from the primer curing furnace at a temperature at least approaching that required for the melt-off of the solid block paint composition. Indeed, in installations where the strip proceeds directly from the priming station to the finish coating station, the priming furnace may be controlled to ensure that the strip leaves it at an appropriate temperature. More usually, however, the primed strip is passed through a dedicated pre-heat furnace 5 to attain that temperature, which is preferably within the range of from 130° C. to 210° C., and then passes to the coating applicator 6.

The coating applicator 6 comprises a chute or guide 10 locating a block 11 of the paint composition and a pneumatic or other thrustor 12 urging the block 11 through the guide 10 into contact with the strip 4.

The strip 4, in contact with the block 11 is hotter than the glass transition temperature of the polymeric material in the block and thus a lower surface layer of the block is continuously melted and carried away by the strip as a relatively non-uniform liquid layer 13 thereon. The rate of melt-off is controlled by several parameters, including the contact length of the block and strip in the direction of strip travel, the coating composition, the strip temperature and the strip speed. In experiments leading to the present invention it has been found that if all the mentioned parameters are constant, as would be the case in a normal operating installation, then, within absolute limits set by those parameters, (for example, if the strip temperature were below the glass transition temperature there would be no melt-off, or if the strip speed is excessive or the contact distance very small there would be very little melt-off and the applied liquid coat would necessarily be very thin and maybe patchy) the thickness of the applied liquid layer 13 depends on the pressure between the block and the strip. Within those limits, if the pressure is increased the thickness of the layer 13 increases and, if the pressure is decreased the thickness of the layer decreases.

In a given situation an appropriate pressure may be determined by trial and error. In the illustrated embodiment the operating pneumatic pressure within the thrustor 12 may be kept constant, or it may be increased gradually as the block 11 is consumed, to compensate for the loss of weight in the block and maintain the pressure between the block and the strip substantially constant.

By way of example, it is mentioned that for a strip temperature within the range of from 100° to 210° C., a strip speed within the range of from 20 to 200 meters per minute, a paint composition based on a polymeric resin having a glass transition temperature within the range of from −10° to 40° C. and a contact length within the range of from 30 to 300 millimeters, then an appropriate range (depending on the desired paint thickness) for the pressure between the paint block and the strip is from 10 to 100 kilopascals.

The block 11 may be of any high solids, thermosetting polymer based paint composition wherein the polymer has a glass transition temperature appreciably below convenient operating temperatures for the preheated strip. Appropriate polymers include polyester, silicone modified polyester, epoxy, acrylic, melamine-formaldehyde, and urethane resins and mixtures thereof.

The liquid layer of paint composition 13 thus formed on the strip 4 is then smoothed and doctored to thickness by the smoothing device 7. That device comprises a steel support roll 14 supporting the strip 4, a resilient doctor roll 15, and weirs 16 disposed one at each edge of the strip 4 to prevent spillage. The roll 14 is rotated so that its surface speed is substantially the same as that of the strip 4, and that part of the roll touching the strip moves in the same direction as the strip. The same may apply to the doctor roll 15 except that its surface speed may be about 10–20% of that of the strip. A light pressure is maintained between the rolls and some surplus coating 13 may build up at 17.

The doctor roll 15 may be a rubber coated roll. For example it may comprise a surface layer of about 20 mm thickness of a heat resistant silicone or other rubber upon a steel core. That rubber may have a Shore A hardness of from 45 to 65, say about 55.

Thus, the device 7 may be designated as a forward acting, single roll, smoothing device.

For preference the block 11 is of slightly less width than the strip 4, so that narrow edge margins of the strip are free of layer 13 as the strip enters the nip of rolls 14 and 15. Those rolls then spread the liquid layer over the full width of the strip and at the same time slightly reduce its average thickness. That reduction enables the rolls to produce a desirably smooth coating, and the spreading enables the volume of liquid on the strip per unit length of strip to be substantially the same before and after passage between the rolls notwithstanding that reduction. This enables the melt-off rate to be adjusted so that the operation may proceed continuously for lengthy periods without under thickness coatings being produced or excessive spillage of surplus coating material occurring ahead of the nip of rolls 14 and 15.

The passage of the strip through the smoothing device 7 results in a smooth coating of predetermined thickness on the emergent strip.

Notwithstanding that the block 11 is essentially free of solvents, a small quantity of volatiles may be produced by the heating of the paint and thus fume extraction means, indicated by the hood 18 in FIG. 1, may be provided over device 7.

It should be emphasised that FIG. 1 is diagrammatic. In practice the applicator 6 and the smoothing device 7 are positioned so that there is insufficient time for liquid layer 13 to increase in viscosity, by cross-linking, to a significant extent before entering the nip of the rolls 14 and 15.

Upon emerging from the smoothing device 7, the coated strip travels through the curing furnace 8, wherein the coating is heated to a curing temperature of say 220°-270° C., whereby it is cured.

The cured coating and the strip may then be quenched by passage through the bath 9, or otherwise cooled to room temperature for re-coiling and removal as finished product.

FIG. 3 illustrates an alternative smoothing device. It comprises a steel support roll 18, a resilient applicator roll 19 and a steel doctor roll 20.

All of the rolls turn in the directions of the arrows appearing on them in FIG. 3, and the pressure between the rolls 18 and 19 is relatively high. The device operates as follows. Coating 21 (corresponding to coating 13 of FIG. 2) is deposited on the strip by the novel, block melt-off type applicator already described. That coating cannot readily pass through the nip of rolls 18 and 19 and is substantially picked up by the latter. The picked up coating on roll 19 is then doctored to thickness and smoothed by the doctor roll 20 as it travels through the nip of rolls 19 and 20. The smoothed coating is then carried on by roll 19 and applied to the strip in much the same way as a conventional liquid coating is applied by a conventional roll applicator. For preference, the surface speed of the applicator roll 19 is from 70 to 130% of the speed of travel of the strip, and the surface speed of the doctor roll 20 is from 10 to 20% of that of the applicator roll 19.

Thus the device of FIG. 3 may be designated a reverse acting, double roll, smoothing device.

In other embodiments of forward acting, single roll, or reverse acting, double roll, smoothing devices useable in coating procedures according to the invention, the single support rolls 14 and 18 may be replaced by two spaced apart support rolls respectively positioned slightly upstream and downstream of the roll 15 or 19 as the case may be. This provides some resilience between the strip and roll 15 or 19 and renders the device less sensitive to inadvertent variations in the melt-off rate of the applicator.

In still other embodiments, where a slightly lower quality of surface finish may be accepted, the above described roll type, smoothing devices may be replaced by one or two support rolls and a simple, fixed doctor blade.

I claim:

1. A method of continuously coating at least one side of a substantially continuous metal strip with a thickness of a coat of paint of a thermosetting polymeric composition which comprises:

providing a solid block of a substantially solvent free paint composition comprising an uncured thermosetting polymer having a glass transition temperature;

pre-heating said strip to a pre-heated temperature above said glass transition temperature;

moving said heated strip relative to said block;

contacting said side of said relatively moving strip with said block under sufficient pressure to cause paint composition in said block to be liquified and transferred at a rate sufficient to provide a layer of said coat of paint on said side of said strip which is carried away from said block as a deposit partially covering the surface of said side moving away from said block;

spreading said deposit layer across the full width of said side so that the spread deposit extends without interruption from edge to edge of said side and smoothing the exposed surface of the spread deposit; and then heating said spread and smoothed deposit to a curing temperature sufficient to cure said thermosetting polymer, whereby producing a substantially uniform, cured coat of paint of substantially said thickness covering said side of said strip.

2. A method according to claim 1 wherein the width of said block is less than the width of said strip whereby the width of said deposit layer carried away from said block is less than the width of said strip.

3. A method according to claim 1 including the further step of quenching said strip and said coat of paint thereon.

4. A method according to claim 1 wherein said preheated temperature is within the range of from 100° to 210° C.

5. A method according to claim 1 wherein said strip moves at a speed within the range of from 20 to 200 meters per minute.

6. A method according to claim 1 wherein the contact length of the block and the strip in the direction of travel of the strip is within the range of from 30 to 300 millimeters.

7. A method according to claim 1 wherein the pressure between the strip and the block is within the range of from 10 to 100 kilopascals.

8. A method as claimed in claim 1 wherein said pressure is substantially constant.

9. The method as claimed in claim 1, wherein said curing temperature is higher than said glass transition temperature.

10. A method according to claim 1 wherein said spreading and smoothing is effected by mechanically pressing said deposit against said side of said strip.

11. The method as claimed in claim 1 including the further step of applying an adherent primer coating to said side of said strip prior to contacting said strip with said block, whereby said coat of paint covers said primer coating.

12. The method as claimed in claim 1 wherein said strip is substantially endless.

13. A method according to claim 9 wherein said glass transition temperature is within the range of from −10° to 40° C.

14. A method according to claim 9 wherein said curing temperature is within the range of from 220° to 270° C.

15. A method according to claim 6 wherein the step of spreading and smoothing said deposit layer is effected by a forward acting, single roll, smoothing device.

16. A method according to claim 10 wherein the step of spreading and smoothing said deposit layer is effected by a reverse acting, double roll, smoothing device.

17. The method of applying an adherent coating of paint to a surface of a strip of metal which comprises:

providing a substantially solid block of lesser width than said strip comprising a paint composition including a substantially uncured thermosetting polymer having a glass transition temperature;

preheating said strip to a temperature above said glass transition temperature;

moving said block and said strip relative to each other;

contacting said block and said strip under sufficient pressure and for a sufficient time to liquify a portion of said block, and to deposit an amount of said liquid on at least one surface of said strip which is of lesser width than said strip but of sufficient quantity to substantially cover said surface, but not overflow such, in a thickness of paint;

smoothing and spreading said deposited liquid to substantially cover and not substantially overflow said surface with a substantially uniform thickness of said liquid; and curing said thermosetting polymer to an extent sufficient to adhere such to said surface of said strip with a force at least substantially the same as the adherence of paint.

18. The method as claimed in claim 17 including smoothing and spreading said coating by mechanically pressing said deposited thermosetting polymer against said side of said strip, after said coating has been transferred from said block to said strip surface.

* * * * *